US007031488B2

(12) United States Patent
Chang

(10) Patent No.: US 7,031,488 B2
(45) Date of Patent: Apr. 18, 2006

(54) SUPER TWEETER

(75) Inventor: Tzu-Chung Chang, Tainan (TW)

(73) Assignee: Sun Technique Electric Co., Ltd., (TW)

( * ) Notice: Subject to any disclaimer, the term of this patent is extended or adjusted under 35 U.S.C. 154(b) by 0 days.

(21) Appl. No.: 10/829,941

(22) Filed: Apr. 23, 2004

(65) Prior Publication Data

US 2005/0238197 A1 Oct. 27, 2005

(51) Int. Cl.
*H04R 25/00* (2006.01)

(52) U.S. Cl. ..... 381/398; 381/423; 381/424

(58) Field of Classification Search ..... 381/340–343, 381/398, 401, 423, 424, 430, 432, 182, 184, 381/186, 396; 181/152, 156, 163–165, 171–173
See application file for complete search history.

(56) References Cited

U.S. PATENT DOCUMENTS 3,665,124 A * 5/1972 Sotome ..... 381/401

6,320,970 B1 * 11/2001 Czerwinski et al. ..... 381/343

* cited by examiner

*Primary Examiner*—Huyen Le
(74) *Attorney, Agent, or Firm*—Bacon & Thomas, PLLC

(57) ABSTRACT

A super tweeter includes a magnetic base, a voice coil, a frame annularly mounted to the magnetic base, a central supporting member mounted on a central portion of the magnetic base, a diaphragm, an annular inner supporting member, and an annular outer supporting member. The diaphragm is connected between an annular outer side of the annular inner supporting member and an annular inner side of the annular outer supporting member. An annular inner side of the annular inner supporting member is engaged with the central supporting member. An annular outer side of the annular outer supporting member is engaged with the frame. The annular inner supporting member and the annular outer supporting member cause the diaphragm to vibrate in a balanced manner, generating super high frequency range of sound waves.

5 Claims, 4 Drawing Sheets

SUPER TWEETER

BACKGROUND OF THE INVENTION

1. Field of the Invention

The present invention relates to a super tweeter that can produce excellent sound quality in the frequency range between 500 Hz and 100 kHz.

2. Description of Related Art

FIG. 1 of the drawings illustrates a typical conventional tweeter. The tweeter includes a magnetic base 10, a diaphragm 20, a voice coil 30, and a frame 40. The magnetic base 10 includes a U-iron 11, a magnet 12, and a pole plate 13. The voice coil 30 is bonded by adhesive to the diaphragm 20. The voice coil 30 is formed by means of winding a copper wire and positioned in an annular gap between the U-iron 11 and the pole plate 13. The frame 40 is annularly mounted to the magnetic base 10, with the diaphragm 20 being bonded to the frame 40.

The tweeter having the above-mentioned simple structure can be easily manufactured at a low cost. Nevertheless, it was found that the diaphragm 20 could not effectively balance the vibrations or could not effectively absorb the lagging vibration waves. Thus, in some cases, when the voice coil 30 is energized to create a magnetic field and thus generate vibration waves after induction, imbalanced vibration waves are apt to exist among all orientations of the diaphragm 20. In other cases, the lagging vibration waves will result in random reflective waves that interfere with one another. The sound quality of the tweeter is extremely unacceptable in the frequency range between 20 kHz and 100 kHz, as shown in FIG. 2.

OBJECTS OF THE INVENTION

An object of the present invention is to provide a super tweeter that can produce excellent sound quality in the super high frequency range of sound waves.

Another object of the present invention is to provide a super tweeter than can produce excellent sound quality throughout the whole frequency range of sound waves.

SUMMARY OF THE INVENTION

In accordance with an aspect of the invention, a super tweeter includes a magnetic base, a voice coil, a frame annularly mounted to the magnetic base, a central supporting member mounted on a central portion of the magnetic base, a diaphragm, an annular inner supporting member, and an annular outer supporting member.

The diaphragm is connected between an annular outer side of the annular inner supporting member and an annular inner side of the annular outer supporting member. An annular inner side of the annular inner supporting member is engaged with the central supporting member. An annular outer side of the annular outer supporting member is engaged with the frame. The annular inner supporting member and the annular outer supporting member cause the diaphragm to vibrate in a balanced manner, generating super high frequency range of sound waves.

In an embodiment of the invention, the diaphragm is made of a light and rigid material, and the annular inner supporting member and the annular outer supporting member are made of a resilient and soft material different from that of the diaphragm. The voice coil is glued at a position below the diaphragm.

In an embodiment of the invention, the magnetic base includes a T-iron, a magnet, and a pole plate, and the voice coil is positioned in a gap between the T-iron and the pole plate. The central supporting member is mounted on a central portion of the T-iron of the magnetic base. A central dome is mounted on top of the central supporting member, and the annular inner supporting member is engaged between the central supporting member and the central dome.

In another embodiment of the invention, the magnetic base includes a U-iron, a magnet, and a pole plate, and the voice coil are positioned between a gap between the U-iron and the pole plate.

Other objects, advantages and novel features of this invention will become more apparent from the following detailed description when taken in conjunction with the accompanying drawings.

DETAILED DESCRIPTION OF THE PREFERRED EMBODIMENTS

Preferred embodiments of the present invention are now to be described hereinafter in detail, in which the same referential numerals are used for the same parts as those in the prior art to avoid redundant description.

Figure 1:
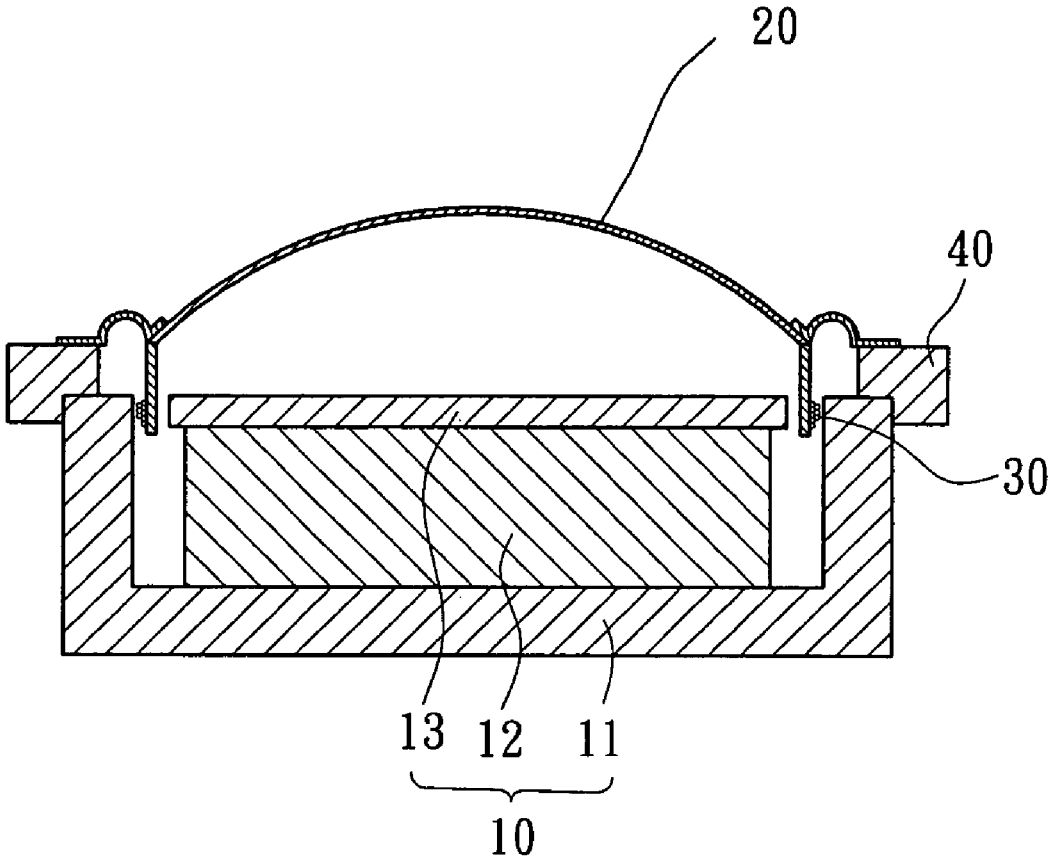
FIG. 1 PRIOR ART
FIG. 1 is a sectional view of a conventional tweeter.
Figure 2:
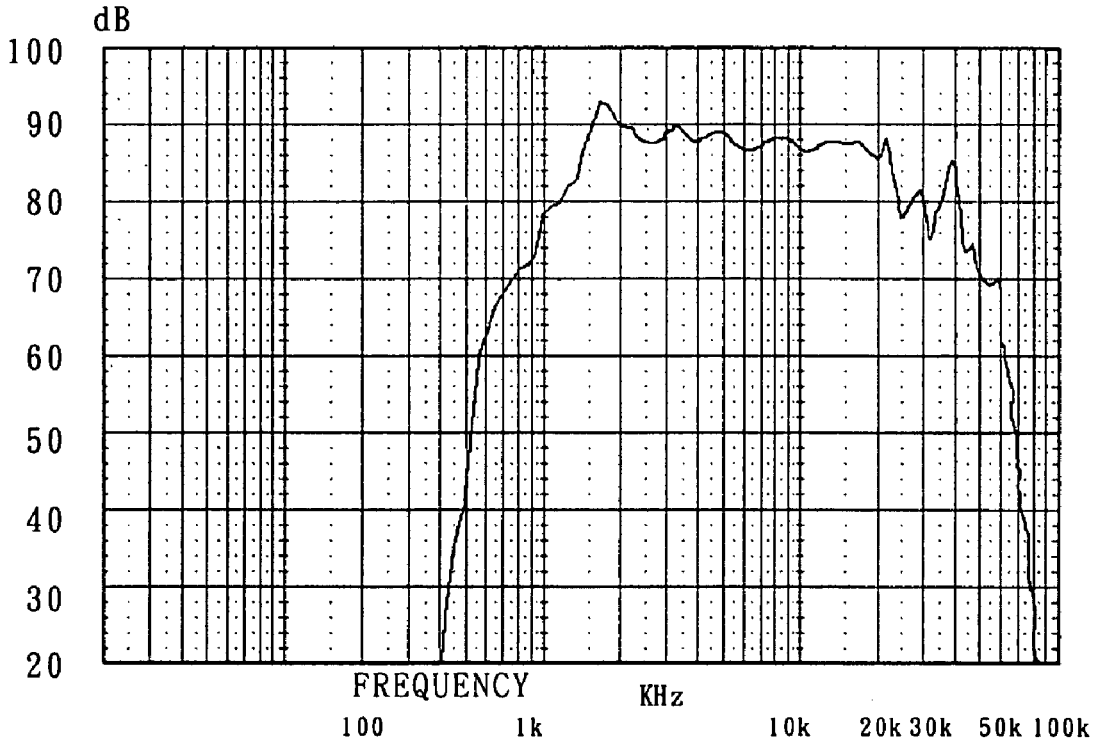
FIG. 2 PRIOR ART
FIG. 2 is a frequency response diagram of the conventional tweeter in FIG. 1.
Figure 3:
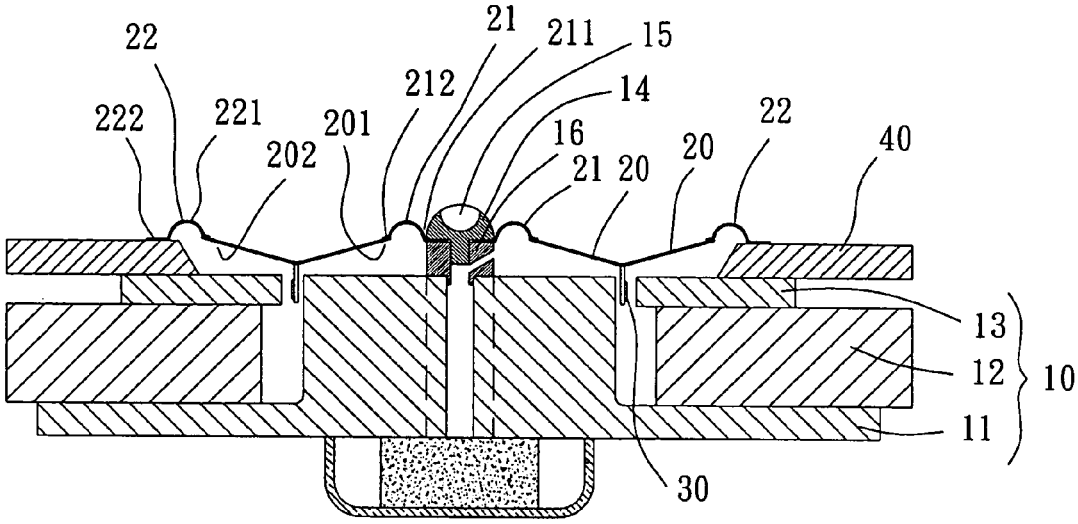
FIG. 3 is a sectional view of an embodiment of a super tweeter in accordance with the present invention.

Referring to FIG. 3, a super tweeter in accordance with the present invention includes a magnetic base 10, a diaphragm 20, an annular inner supporting member 21, an annular outer supporting member 22, a voice coil 30, and a frame 40. The magnetic base 10 includes a T-iron 11, a magnet 12, and a pole plate 13. The diaphragm 20 is connected to the annular inner supporting member 21, the annular outer supporting member 22, and the voice coil 30. Provision of the annular inner and outer supporting members 21 and 22 and the voice coil 30 allows the diaphragm 20 to generate sound waves in the frequency range between 500 Hz and 100 kHz, which will be described in detail later.

Still referring to FIG. 3, the T-iron 11 of the magnetic base 10 is made of a ferrous material for bearing the magnet 12. A central supporting member 16 is mounted on a central portion of the T-iron 11, and a central dome 14 is mounted on top of the central supporting member 16. The pole plate 13 is fixed on top of the magnet 12, with a gap being defined between the T-iron 11 and the pole plate 13.

The diaphragm 20 is made of a light and rigid material and includes an annular inner side 201 and an annular outer side 202. The annular inner supporting member 21 and the annular outer supporting member 22 are made of a resilient and soft material different from that of the diaphragm 20. The annular inner supporting member 21 includes an annular inner side 211 and an annular outer side 212. Similarly, the annular outer supporting member 22 includes an annular inner side 221 and an annular outer side 222.

The annular inner side 211 of the annular inner supporting member 21 is engaged with the central supporting member 16 on the T-iron 11. The annular inner side 211 of the annular inner supporting member 21 is engaged between the central supporting member 16 and the central dome 14. The annular outer side 212 of the annular inner supporting member 21 is connected to the annular inner side 201 of the diaphragm 20. The voice coil 30 is glued and thus fixed at a position below the diaphragm 20 and in the gap between the T-iron 11 and the pole plate 13. The annular outer side 222 of the annular outer supporting member 22 is securely mounted on the frame 40, and the inner side 221 of the annular outer supporting member 22 is connected to and thus supports the annular outer side 202 of the diaphragm 20. The frame 40 is located around the magnetic base 10, and a light-emitting diode (LED) 15 is mounted on the central dome 14.

Figure 5:
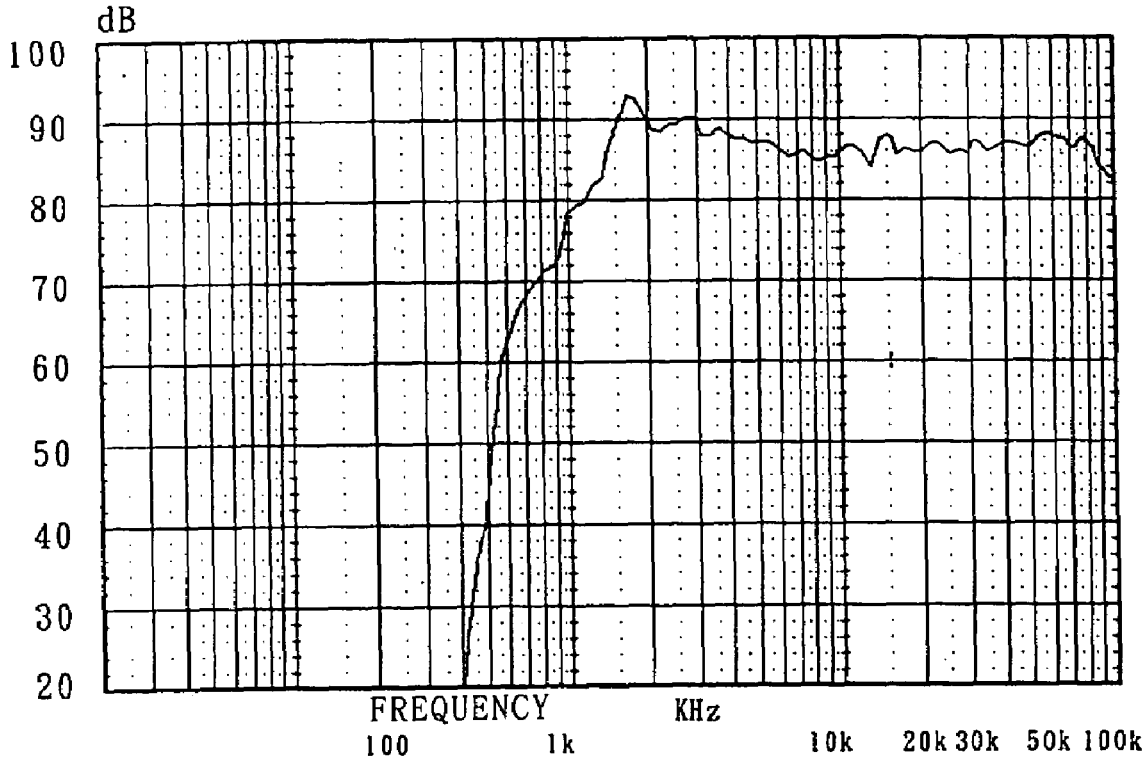
FIG. 5 is frequency response diagram of the tweeter in FIG. 3.

Still referring to FIG. 3, when the voice coil 30 is energized to create a magnetic field, vibration waves are generated as a result of an induction between the voice coil 30 and the magnetic field (created by the T-iron 11, the magnet 12, and the pole plate 13) in the gap. The vibration waves are transmitted to the diaphragm 20 and cause nearby air to generate sound waves. At this time, the diaphragm 20 utilizes the annular inner supporting member 21 and the annular outer supporting member 22 to balance the vibration waves. Further, the annular inner supporting member 21 and the annular outer supporting member 22 absorb the lagging vibration waves, avoiding mutual interference between the previous vibration waves and the present vibration waves. Thus, the diaphragm 20 generates sound waves in the range between 20 kHz and 100 kHz. Namely, the super tweeter can produce excellent sound quality in the super high frequency range of sound waves (see FIG. 5).

Figure 4:
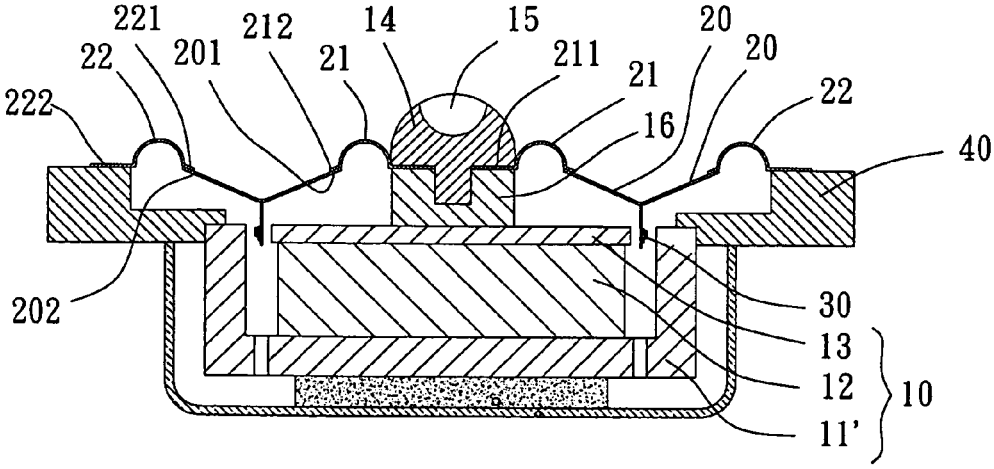
FIG. 4 is a sectional view of another embodiment of the super tweeter in accordance with the present invention.

FIG. 4 illustrates another embodiment of the super tweeter in accordance with the present invention, wherein the super tweeter includes a magnetic base 10, a central supporting member 16, a central dome 14, an LED 15, a diaphragm 20, an annular inner supporting member 21, an annular outer supporting member 22, a voice coil 30, and a frame 40. In this embodiment, the magnetic base 10 includes a U-iron 11', a magnet 12, and a pole plate 13.

The U-iron 11' of the magnetic base 10 is made of a ferrous material, with the magnet 12 being fixed to an inner face of a bottom of the U-iron 11'. The pole plate 13 is mounted on top of the magnet 12, with a gap being defined between the pole plate 13 and the U-iron 11'. The central supporting member 16 is mounted on a central portion of the pole plate 13. The central supporting member 16 and the central dome 14 together fix the annular inner side 211 of the annular inner supporting member 21. Other structures of this embodiment are identical to those of the above embodiment. Further, the super tweeter of this embodiment provides functions substantially the same as those of that of the above embodiment.

As apparent from the foregoing, the annular inner supporting member 21 and the annular outer supporting member 22 together support the diaphragm 20 and thus allow the super tweeter to produce excellent sound quality in the super high frequency range of sound waves.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A super tweeter comprising:

a magnetic base;

a single voice coil;

a frame annularly mounted to the magnetic base;

a central supporting member mounted on a central portion of the magnetic base;

a diaphragm including an annular inner side and an annular outer side, the diaphragm made of a light and rigid material;

an annular inner supporting member including an annular inner side and an annular outer side, the annular inner supporting member made of a resilient and soft material different from that of the diaphragm; and an annular outer supporting member including an annular inner side and an annular outer side, the annular outer supporting member made of a resilient and soft material different from that of the diaphragm;

wherein the diaphragm is attached to the annular outer side of the annular inner supporting member and the annular inner side of the annular outer supporting member such that the combination of the single voice coil with the diaphragm is located between the annular inner supporting member and the annular outer supporting member, the annular inner side of the annular inner supporting member is engaged with the central supporting member, the annular outer side of the annular outer supporting member is engaged with the frame so that the single voice coil is spaced apart from the annular inner supporting member and the annular outer supporting member, the annular inner supporting member and the annular outer supporting member causing the diaphragm to vibrate in a balanced manner, generating super high frequency range of sound waves.

2. The super tweeter as claimed in claim 1, wherein the voice coil is glued at a position below the diaphragm.

3. The super tweeter as claimed in claim 1, wherein the magnetic base includes a T-iron, a magnet, and a pole plate, and wherein the voice coil is positioned in a gap between the T-iron and the pole plate.

4. The super tweeter as claimed in claim 3, wherein the central supporting member is mounted on a central portion of the T-iron of the magnetic base, a central dome being mounted on top of the central supporting member, the annular inner supporting member being engaged between the central supporting member and the central dome.

5. The super tweeter as claimed in claim 1, wherein the magnetic base includes a U-iron, a magnet, and a pole plate, and wherein the voice coil is positioned between a gap between the U-iron and the pole plate.

* * * * *